US008310428B2

(12) United States Patent
Nakayama

(10) Patent No.: US 8,310,428 B2
(45) Date of Patent: Nov. 13, 2012

(54) DISPLAY PANEL DRIVING VOLTAGE OUTPUT CIRCUIT

(75) Inventor: Akira Nakayama, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 542 days.

(21) Appl. No.: 12/618,815

(22) Filed: Nov. 16, 2009

(65) Prior Publication Data

US 2010/0128027 A1 May 27, 2010

(30) Foreign Application Priority Data

Nov. 21, 2008 (JP) ..... 2008-297925

(51) Int. Cl.
*G09G 3/36* (2006.01)

(52) U.S. Cl. ..... 345/96; 345/98; 330/255

(58) Field of Classification Search ..... None
See application file for complete search history.

(56) References Cited

U.S. PATENT DOCUMENTS 5,973,660 A * 10/1999 Hashimoto ..... 345/98
6,424,219 B1 * 7/2002 Kato ..... 330/255
7,551,030 B2 * 6/2009 An et al. ..... 330/255
7,671,831 B2 * 3/2010 Chang et al. ..... 345/100
8,184,083 B2 * 5/2012 Chung ..... 345/98
2009/0040165 A1 * 2/2009 Shimatani ..... 345/98
2009/0167667 A1 * 7/2009 Suzuki ..... 345/96

FOREIGN PATENT DOCUMENTS

JP 10-062744 3/1998

* cited by examiner

*Primary Examiner* — Joseph Haley
(74) *Attorney, Agent, or Firm* — Volentine & Whitt, PLLC

(57) ABSTRACT

A driving voltage output circuit for a matrix display panel includes high-side voltage followers and low-side voltage followers. Each voltage follower includes a differential input stage, a control stage, and an output stage. First and second transistors in the differential input stage receive non-inverting and inverting inputs and produce first and second potentials that control the control stage. Third and fourth transistors of different channel types in the control stage are connected in a push-pull configuration between high-side and low-side power supply potentials to generate a control potential. Fifth and sixth transistors of identical channel types in the output stage are connected in series between an intermediate reference potential and one of the power supply potentials, and are controlled by the first potential and the control potential to generate an output potential. The output potential is fed back as the inverting input.

5 Claims, 6 Drawing Sheets

DISPLAY PANEL DRIVING VOLTAGE OUTPUT CIRCUIT

BACKGROUND OF THE INVENTION

1. Field of the Invention

The present invention relates to a driving voltage output circuit for a display panel such as an active matrix liquid crystal panel.

2. Description of the Related Art

Alternate current (AC) driving is known to be a necessary condition for maintenance of the long-term reliability of liquid crystal panels. U.S. Pat. No. 5,973,660 to Hashimoto (Japanese Patent Application Publication No. 10-062744, now Japanese Patent No. 3056085) describes a drive circuit with high-voltage circuits for generating and selecting driving voltages above a common reference voltage and separate low-voltage circuits for generating and selecting driving voltages below the common reference potential. The drive circuit also includes switches that can route the image data for each column of pixels through either the high-voltage or the low-voltage circuits. The switches enable odd-numbered columns to be driven high while even-numbered columns are driven low, or even-numbered columns to be driven high while odd-numbered columns are driven low. Various AC driving schemes are employed: in frame inversion, the switches change once per frame; in one-line dot inversion, the switches change once per line; in two-line dot inversion, the switches change once every two lines.

This driving method conserves power and enables both the high and low driving voltages to be pre-tailored to the gamma curve of the liquid crystal.

The high- and low-voltage circuits also include operational amplifiers operating as voltage followers that output the selected driving voltages on the selected signal lines. The operational amplifiers shown in U.S. Pat. No. 5,973,660 (FIGS. 10 and 11) have a simple circuit configuration consisting of a differential input stage and a single-ended output stage. The output stage includes a field-effect transistor with its source connected to the power supply or ground, its gate connected to the differential input stage, and its drain connected to the output terminal. The drain is also connected through a current source to the reference potential.

A problem with this amplifier circuit is its slow response, due to the limited gain of the differential input stage and the fixed behavior of the current source in the output stage. The slow response is particularly noticeable when the driving voltage must be shifted toward the reference potential.

SUMMARY OF THE INVENTION

An object of the present invention is to provide a faster-operating driving voltage output circuit for a display panel.

The invention provides a driving voltage output circuit with a plurality of high-side voltage followers and a plurality of low-side voltage followers. The high-side voltage followers output driving voltages equal to or greater than a reference potential and equal to or less than a high-side power supply potential. The low-side voltage followers output driving voltages equal to or greater than a low-side power supply potential and equal to or less than the reference potential. The output driving voltages are supplied to column lines in a matrix display panel responsive to display data. Each column line is switched periodically between receiving a driving voltage from one of the high-side voltage followers and receiving a driving voltage from one of the low-side voltage followers.

Each of the high-side voltage followers and each of the low-side voltage followers includes a differential input stage, a control stage, and an output stage.

The differential input stage has an inverting input terminal, a non-inverting input terminal, a first transistor with a control terminal connected to the non-inverting input terminal, a second transistor with a control terminal connected to the inverting input terminal, and a first current mirror connected to controlled terminals of the first and second transistors to supply the second transistor with a current equal to the current conducted by the first transistor. The first and second transistors operate as a differential amplifier, generating a first potential at a node at which the first transistor and the first current mirror are interconnected and a second potential at a node at which the second transistor and the first current mirror are interconnected.

The control stage includes a control circuit that produces a third potential responsive to a difference between the first potential and the second potential, a third transistor with a control terminal receiving the first potential, and a fourth transistor with a control terminal receiving the third potential. The third and fourth transistors are of mutually opposite channel types, and are connected in series, in a push-pull configuration, between a terminal supplying the high-side power supply potential and a terminal supplying the low-side power supply potential to generate a control potential at a node at which the third and fourth transistors are mutually interconnected.

The output stage includes a fifth transistor with a control terminal receiving the first potential and a sixth transistor with a control terminal receiving the control potential. The fifth and sixth transistors are of mutually identical channel types, and are connected in series between a terminal supplying a particular power supply potential and a terminal supplying the reference potential to generate a driving voltage at an output terminal at which the fifth and sixth transistors are mutually interconnected. The particular power supply potential is the high-side power supply potential in the high-side voltage followers and the low-side power supply potential in the low-side voltage followers. The output terminal is connected to the inverting input terminal of the input stage, and to one of the column lines.

The push-pull configuration of the third and fourth transistors in the control stage provides high gain and fast response, and can quickly charge and discharge the gate of the sixth transistor in the output stage. The sixth transistor, in turn, can quickly pull the output potential toward the reference potential, or can substantially shut off to enable the fifth transistor to pull the output potential quickly toward the particular power supply potential. The driving voltage therefore quickly reaches the level corresponding to the display data.

DETAILED DESCRIPTION OF THE INVENTION

Figure 1:
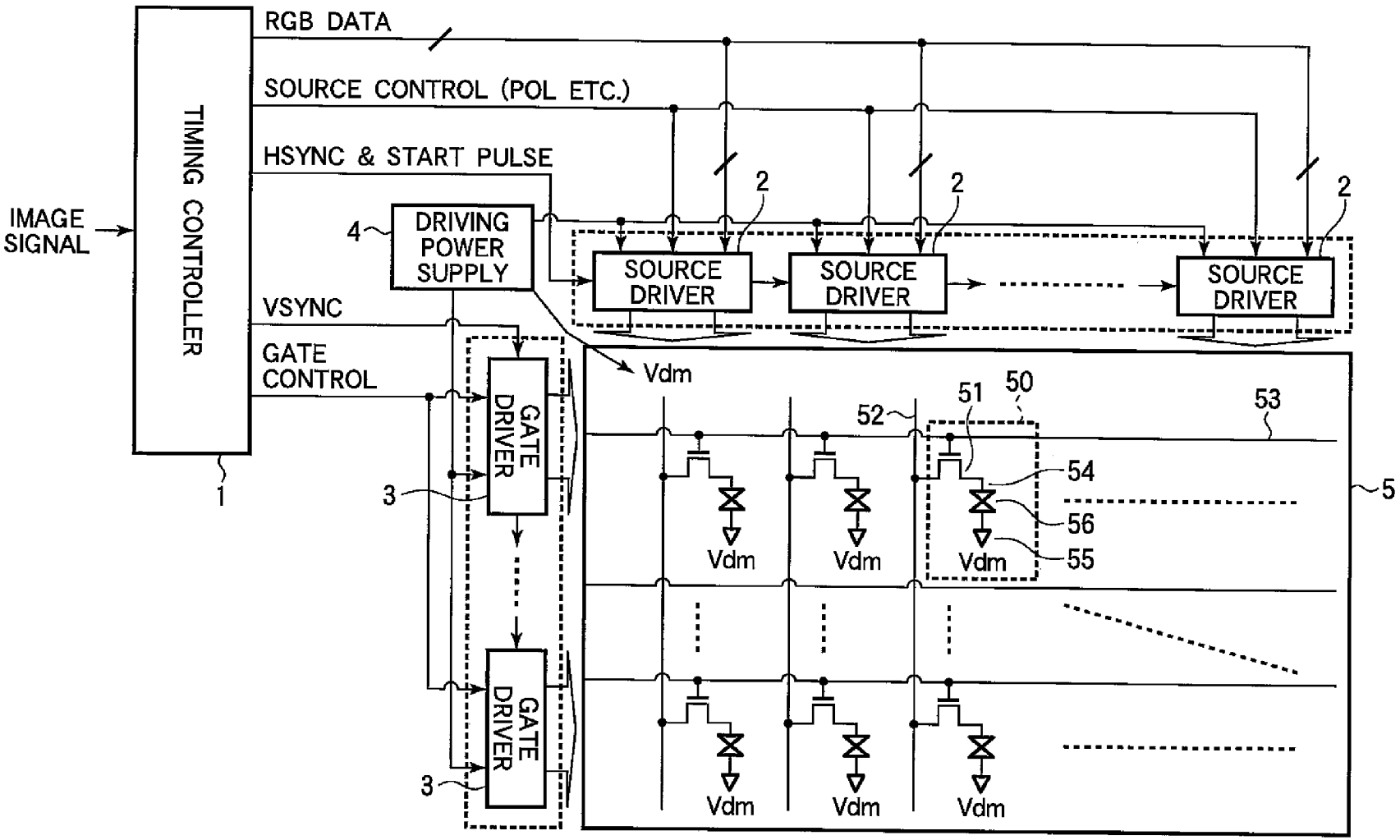
FIG. 1 is a block diagram of a liquid crystal display apparatus employing a driving voltage output circuit according to the present invention.

An embodiment of the invention will now be described with reference to the attached drawings, in which like elements are indicated by like reference characters. In the description, the controlled terminals of a field-effect transistor will be referred to as its source and drain, and the control terminal of a field-effect transistor will be referred to as its gate.

Referring to FIG. 1, the embodiment is used in a liquid crystal display apparatus comprising a timing controller 1, a plurality of source drivers 2, a plurality of gate drivers 3, a driver power supply 4, and a thin-film transistor (TFT) liquid crystal panel 5. The source drivers 2 are cascaded to operate as a single source driver and the gate drivers 3 are cascaded to operate as a single gate driver, as indicated by the encircling dotted lines.

The driver power supply 4 outputs the high-side power supply potential Vdd, the low-side power supply potential Vss, and the reference potential Vdm. Vdm is typically equal to (Vdd−Vss)/2. The driver power supply 4 also outputs a set of potentials grading from Vdm to Vss and a symmetrically opposite set of potentials grading from Vdm to Vss. Exemplary values of Vss, Vdm, and Vdd are 0 V, 5 V, and 10 V, respectively. Vss (0 V) will also be referred to below as the ground potential, and Vdd as the power supply potential.

In the subsequent description and the drawings, Vdd, Vss, and Vdm will also be used to denote terminals that receive these potentials from the driver power supply 4.

The TFT liquid crystal panel 5 includes a plurality of TFTs 51 connected to source signal lines 52, which extend vertically across the panel, and gate signal lines 53, which extend horizontally across the panel. Each TFT 51 is part of a pixel cell that also includes a pixel electrode 54, a common electrode 55, and a liquid crystal element 56. The TFT 51 has source and drain terminals connected to the pixel electrode 54 and one of the source signal lines 52, and a gate terminal connected to one of the gate signal lines 53. The liquid crystal element 56 is disposed between the pixel electrode 54 and the common electrode 55. The common electrodes 55 of all the cells are connected to common lines through which they receive the reference potential Vdm.

The timing controller 1 receives an image signal from an external circuit such as a graphics processor, outputs a vertical synchronizing signal (VSYNC) and gate control signals to the gate drivers 3, and outputs a horizontal synchronizing signal (HSYNC) and start pulse and source control signals to the source drivers 2. The horizontal synchronizing signal and start pulse are synchronized to the vertical synchronizing signal. The source control signals include a polarity control signal (POL) which will be described later. The timing controller 1 also outputs digital red-green-blue (RGB) data to the source drivers 2 and outputs gate control signals to the gate drivers 3. The digital RGB data are obtained from the input image signal by a conversion process if the image signal is not already in digital RGB form.

The gate drivers 3 are mutually identical integrated circuit (IC) chips that collectively select one of the gate signal lines 53 according to the gate control signals received from the timing controller 1 and output a scanning signal onto the selected gate signal line. The scanning signal is generated from a voltage supplied by the driver power supply 4, and turns on the TFTs 51 connected to the selected source signal line 52.

The source drivers 2 are mutually identical IC chips that simultaneously output voltage signals representing pixel gradation levels on the source signal lines 52. The voltage signals are generated by selecting voltages generated by the driver power supply 4 according to the digital RGB data provided by the timing controller 1, and are conducted by the TFTs 51 connected to the selected gate signal line 53 to the pixel electrodes 54 of the corresponding cells, in which they modify the transmittance of the liquid crystal elements 56, thereby displaying a line of pixels in the image.

The transmittance of each liquid crystal element 56 changes in response to the potential difference between the signal voltage applied to the pixel electrode 54 and the reference voltage Vdm of the common electrode 55. The applied signal voltages are alternately higher and lower than Vdm. More precisely, the applied signal voltages are alternately in the high-side range from Vdm to Vdd and the low-side range from Vdm to Vss.

Figure 2:
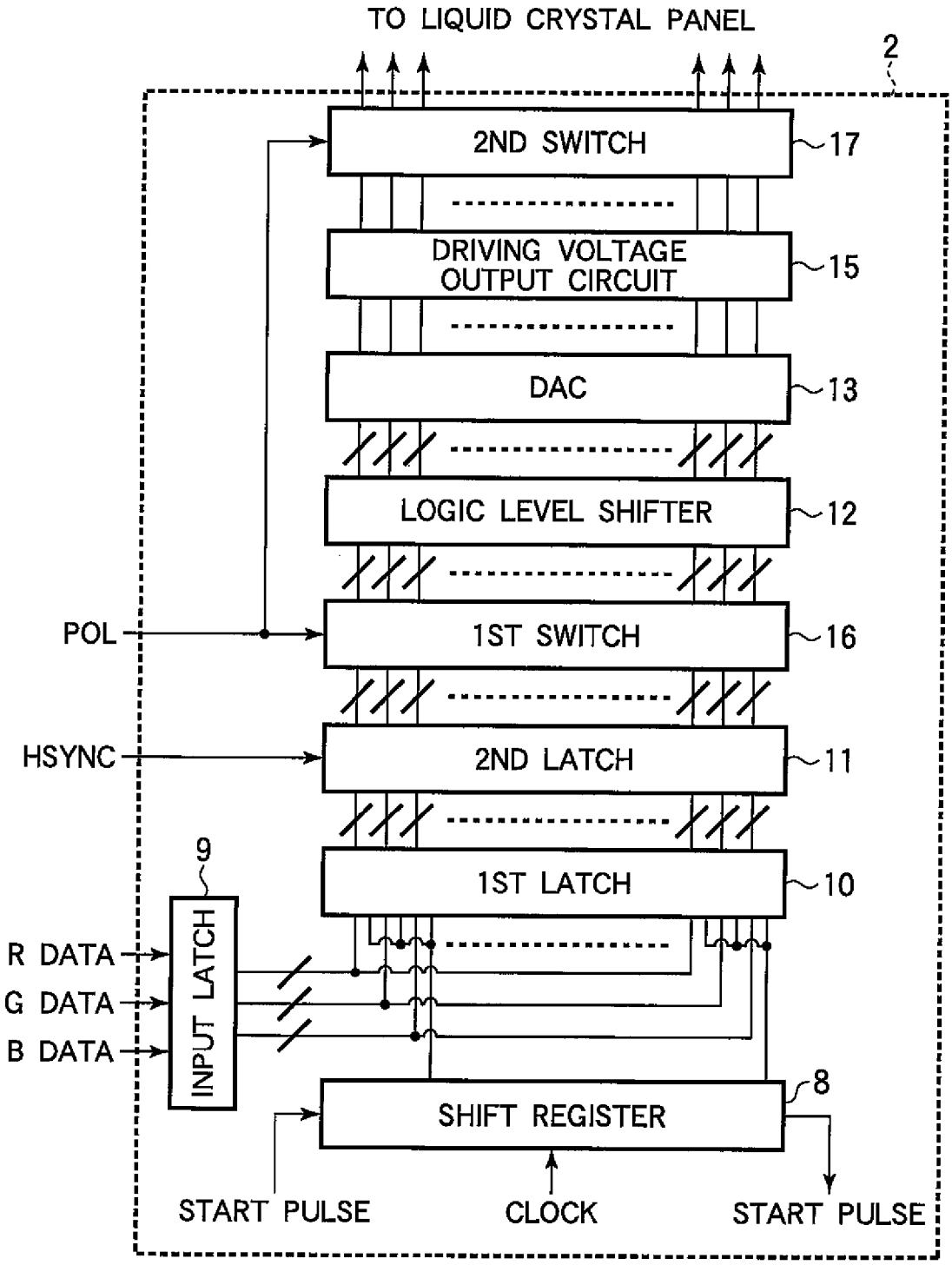
FIG. 2 is a block diagram of the source driver in FIG. 1.

Referring to FIG. 2, each source driver 2 includes a shift register 8, an input latch 9, a first latch circuit 10, a second latch circuit 11, a logic level shifter 12, a digital-to-analog converter (DAC) 13, a driving voltage output circuit 15, a first switch 16, and a second switch 17.

The shift registers 8 in the source drivers 2 are connected in cascade to function as a single shift register through which the start pulse output by the timing controller 1 is shifted in synchronization with a clock signal. The timing controller 1 outputs the digital RGB data in synchronization with the clock signal to the input latches 9 in all the source drivers 2. The shift register 8 controls the first latch circuit 10 in each source driver 2 so that the RGB data for different pixels are latched in different latches, as selected by the current position of the start pulse. When the RGB data for one complete line have been captured in this way, the timing controller 1 outputs a horizontal synchronization signal (HSYNC), causing the second latch circuit 11 in each source driver 2 to latch the captured data. The latched data are then output through the first switch 16 and logic level shifter 12 to the DAC 13 and converted to analog voltage signals. These voltage signals are output through the driving voltage output circuit 15 and second switch 17 to the source signal lines 52. The driving voltage output circuit 15 and second switch 17 are controlled by the polarity control signal (POL) output from the timing controller 1.

Figure 3:
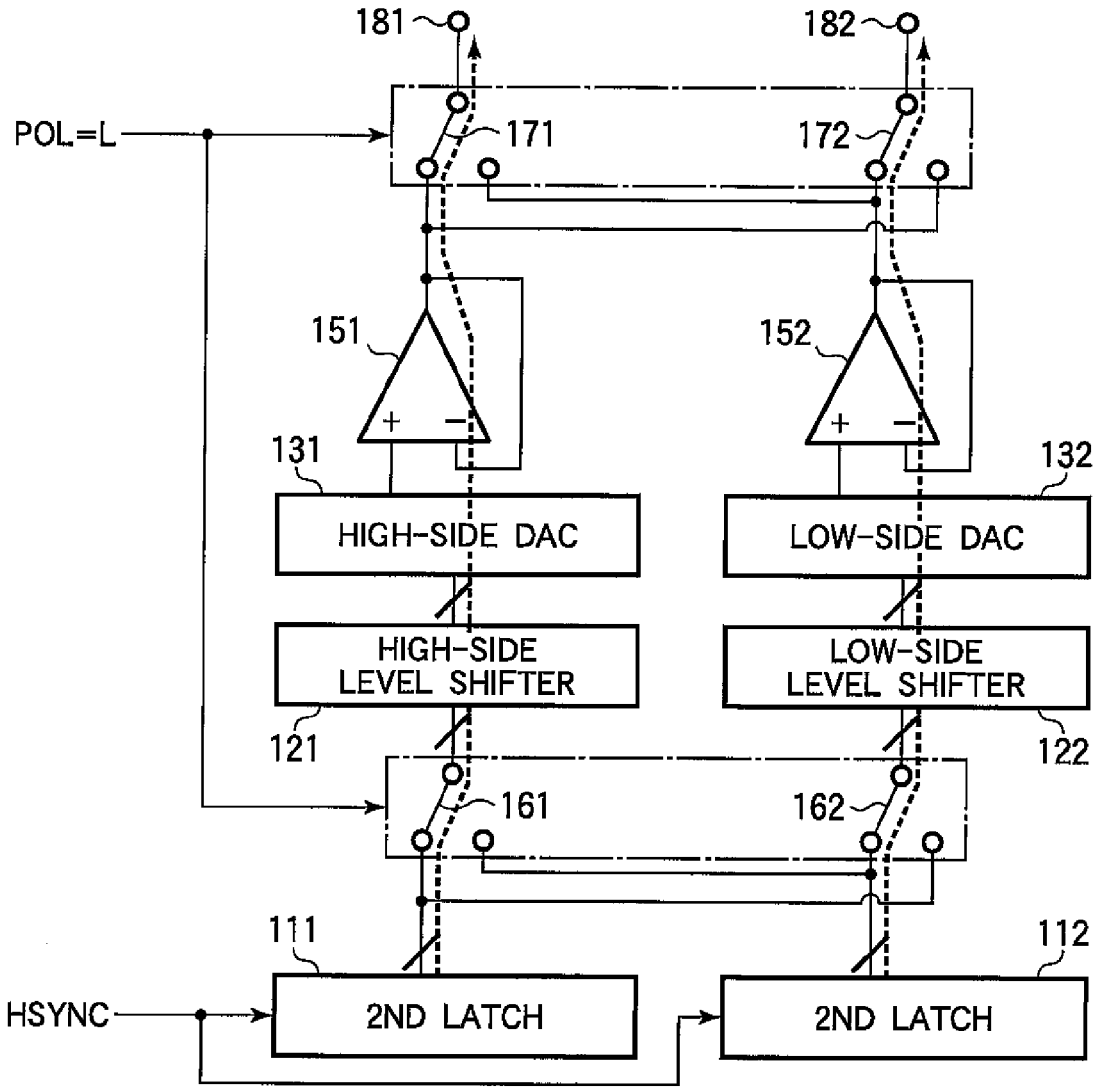
FIGS. 3 and 4 are block diagrams of the source driver circuits connected to an adjacent pair of source lines, illustrating their operation in two different polarity control states.
Figure 4:
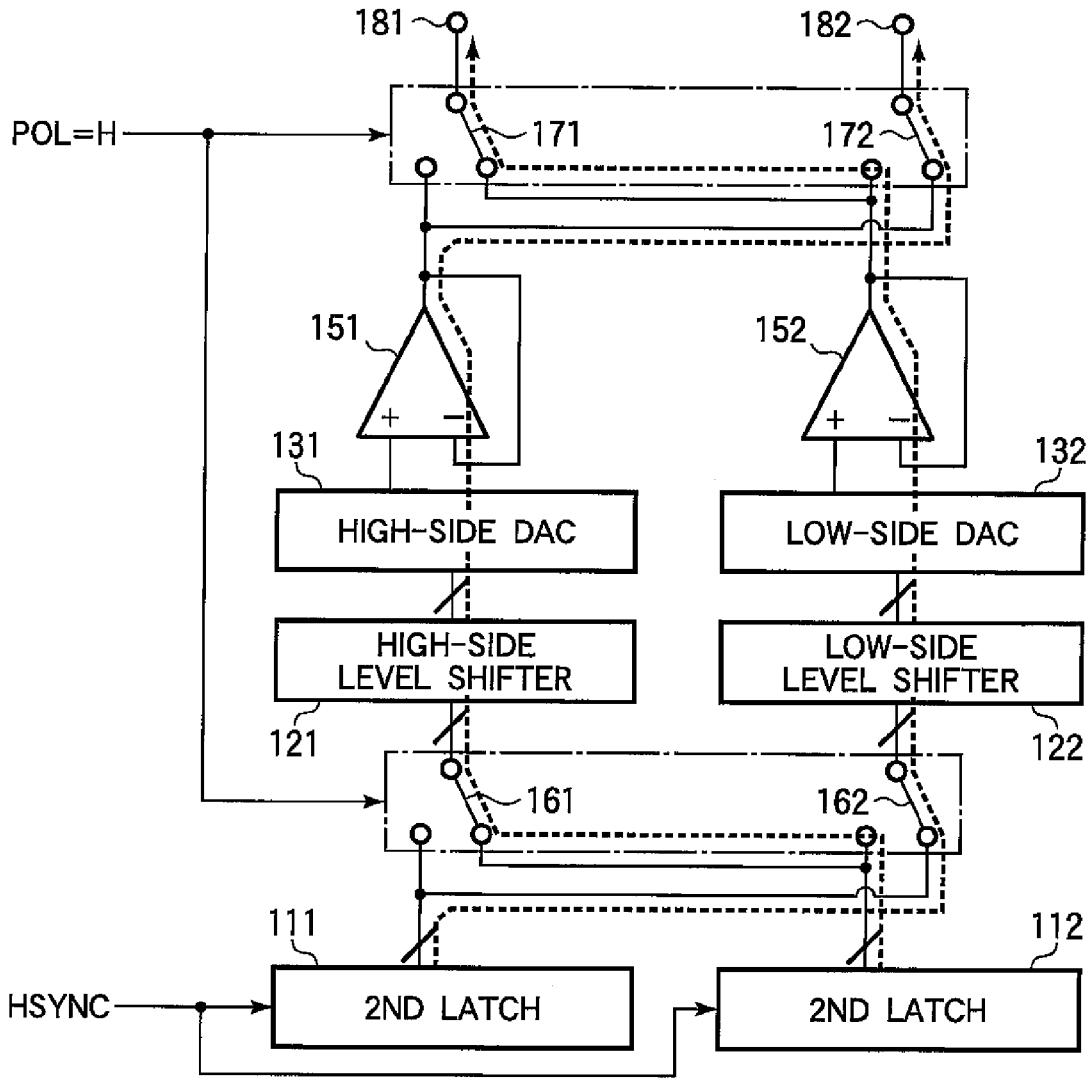

Referring to FIGS. 3 and 4, the circuits that drive a pair of mutually adjacent source signal lines 52 include a pair of latches 111, 112 (both part of the second latch circuit 11 in FIG. 2), a high-side level shifter 121 and a low-side level shifter 122 (both part of the logic level shifter 12 in FIG. 2), a high-side DAC 131 and a low-side DAC 132 (both part of the DAC 13 in FIG. 2), a source amplifier 151 and a sink amplifier 152 (both part of the driving voltage output circuit 15 in FIG. 2), a pair of switches 161, 162 (both part of the first switch 16 in FIG. 2), a pair of switches 171, 172 (both part of the second switch 17 in FIG. 2), an odd-numbered output terminal 181, and an even-numbered output terminal 182.

An odd-numbered source signal line 52 is connected to the odd-numbered output terminal 181. The adjacently following even-numbered source signal line 52 is connected to the even-numbered output terminal 182.

The switches 161, 162, 171, 172 are ganged under control of the polarity control signal POL.

When the polarity control signal POL is at the low logic level (L), the switches are set as shown FIG. 3. The data output from latch 111 are routed through the high-side level shifter 121 to the high-side DAC 131, then (as an analog voltage in the range from Vdm to Vdd) through the source amplifier 151 to the odd-numbered output terminal 181. The data output from latch 112 are routed through the low-side level shifter 122 to the low-side DAC 132, then (as an analog voltage in the range from Vdm to Vss) through the sink amplifier 152 to the even-numbered output terminal 182.

When the polarity control signal POL is at the high logic level (H), the switches are set as shown FIG. 4. The data output from latch 111 are now routed through the low-side level shifter 122 to the low-side DAC 132, then (as an analog voltage equal to or less than Vdm) through the sink amplifier 152 to the odd-numbered output terminal 181. The data output from latch 112 are routed through the high-side level shifter 121 to the high-side DAC 131, then (as an analog voltage equal to or greater than Vdm) through the source amplifier 151 to the even-numbered output terminal 182.

The polarity control signal POL can be controlled to alternate between the high and low logic levels in alternate fields, alternate pixel lines, or alternate pairs of pixel lines for AC driving of the TFT liquid crystal panel 5.

Figure 5:
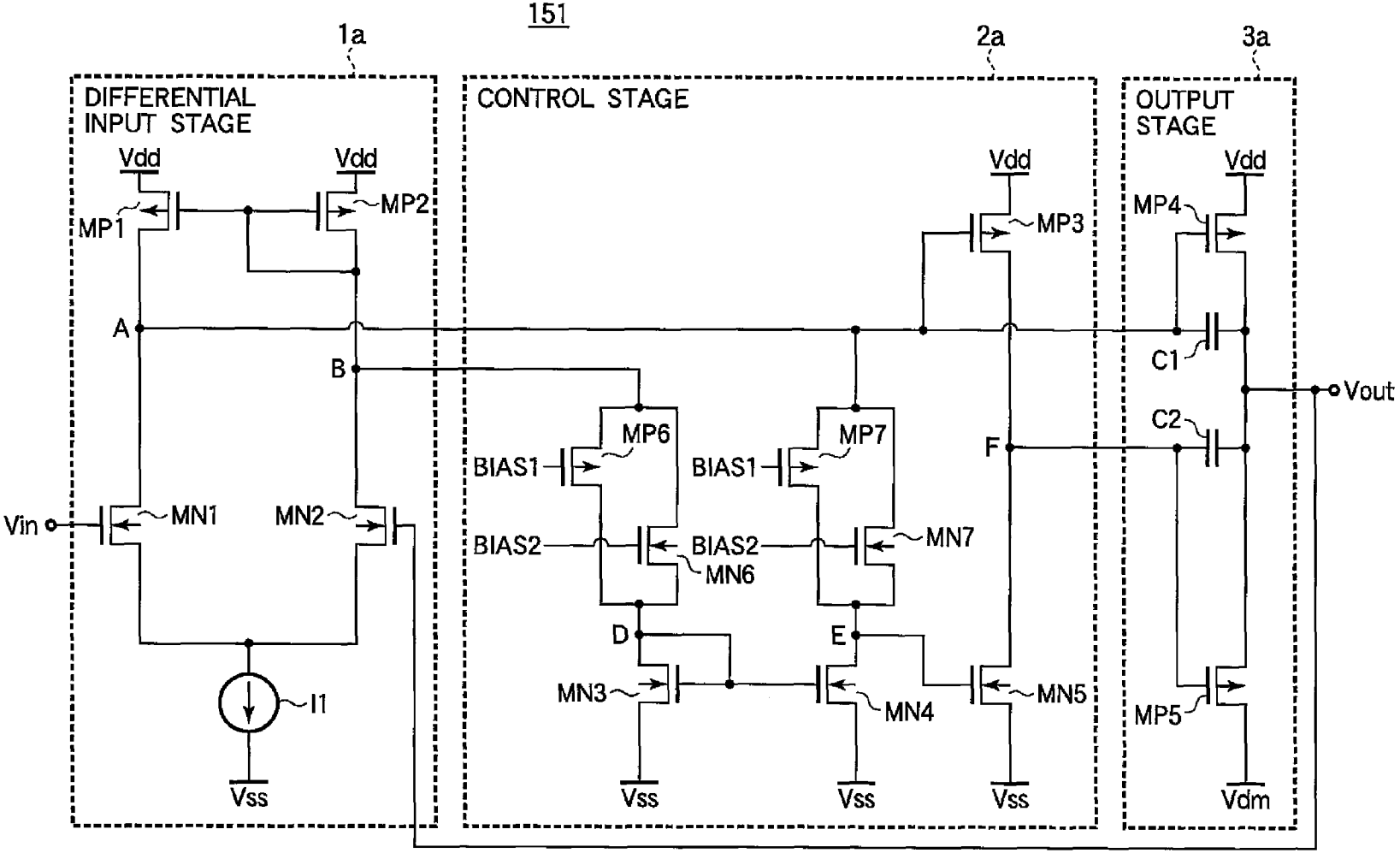
FIG. 5 is a circuit diagram of the source amplifier in FIGS. 3 and 4.

The source amplifier 151 is a high-side voltage follower with the circuit configuration shown in FIG. 5. The output voltage Vout1 of the source amplifier 151 is in the range from the high-side power supply voltage Vdd to the reference voltage Vdm. The sink amplifier 152 is a voltage follower with the circuit configuration shown in FIG. 6. The output voltage Vout2 of the source amplifier 151 is in the range from the reference voltage Vdm to the low-side power supply voltage Vss.

As shown in FIG. 5, the source amplifier 151 has a differential input stage 1*a*, a control stage 2*a*, and an output stage 3*a*. The differential input stage 1*a* includes a pair of n-channel field-effect transistors MN1, MN2 (the first and second transistors), a pair of p-channel field-effect transistors MP1, MP2, and a current source I1, connected to operate as a differential amplifier.

The gate of transistor MN1 functions as the non-inverting input terminal Vin of the source amplifier 151. The control terminal or gate of transistor MN2 functions as the inverting input terminal of the source amplifier 151 and receives the output voltage Vout1 of the source amplifier 151 from the output stage 3*a* as feedback. The source terminals of transistors MN1, MN2 are both connected through the current source I1 to Vss, i.e., to a terminal that receives the ground potential Vss from the driver power supply 4. The source terminals of transistors MP1, MP2 are both connected to Vdd, i.e., to a terminal that receives the power supply potential Vdd from the driver power supply 4. The drains of transistors MN1 and MP1 are interconnected at a node A at which the first potential of the source amplifier 151 is generated. The drains of transistors MN1 and MP1 are interconnected at a node B at which the second potential is generated. The gates of transistors MP1 and MP2 are both connected to the drain of transistor MP2, so that transistors MP1 and MP2 operate as a current mirror (the first current mirror).

The control stage 2*a* includes p-channel field-effect transistors MP3, MP6, MP7 and n-channel field-effect transistors MN3 to MN7. Transistors MN3 and MN4 are interconnected to form the second current mirror. Transistor MP3 (the third transistor) and transistor MN5 (the fourth transistor) are connected in a push-pull configuration. Transistors MP6 and MN6 are connected in parallel between node B and the second current mirror and function as a first current pass circuit or active resistance element. Transistors MP7 and MN7 are connected in parallel between node A and the second current mirror and function as a second current pass circuit or active resistance element.

Specifically, the source of transistor MP6 and the drain of transistor MN6 are both connected to node B in the differential input stage 1*a*. The drain of transistor MP6 and the source of transistor MN6 are both connected through the source and drain of transistor MN3 to Vss. The source of transistor MP7 and the drain of transistor MN7 are both connected to node A in the differential input stage 1*a*. The drain of transistor MP7 and the source of transistor MN7 are both connected through the source and drain of transistor MN4 to Vss. The gates of transistors MN3 and MN4 are both connected to the drain of transistor MN3 at a node D. A first bias voltage BIAS1 is applied to the gates of transistors MP6 and MP7. A second bias voltage BIAS2 is applied to the gates of transistors MN6 and MN7.

Transistor MP3 has its source connected to Vdd, its gate connected to node A in the differential input stage 1*a*, and its drain connected to the drain of transistor MN5 at a node F. The potential of node F is the control potential output from the control stage 2*a*. Transistor MN5 has its gate connected to the drain of transistor MN4 at a node E, and its source connected to Vss. The potential of node E is the third potential. Because of the above interconnections of transistors MP6, MP7, MN3, MN4, MN6, and MN7, the potential of node E varies in response to the potential difference between nodes A and B. The potential of node E is comparatively high when the potential of node A is greater than the potential of node B, and comparatively low when the potential of node A is less than the potential of node B.

The output stage 3*a* includes p-channel field-effect transistors MP4 and MP5 (the fifth and sixth transistors) and a pair of phase compensation capacitors C1, C2. Transistor MP4 has its source connected to Vdd and its gate connected to node A. Transistor MP5 has its drain connected to the reference potential Vdm and its gate connected to node F. The drain of transistor MP4 and the source of transistor MP5 are mutually interconnected and are both connected to the output terminal Vout of the source amplifier 151. Capacitor C1 is connected between the gate and drain of transistor MP4. Capacitor C2 is connected between the gate and source of transistor MP5.

The non-inverting input terminal Vin of the source amplifier 151 receives an input potential in the range from the power supply potential Vdd to the reference potential Vdm. Starting from a state in which the output potential Vout1 is equal to the input potential, if the potential at the non-inverting input terminal Vin shifts upward toward Vdd, increasing the gate-source voltage of transistor MN1, transistor MN1 conducts more drain-source current and the potential at node A falls, discharging the gates and increasing the source-drain current flow of transistors MP3 and MP4. The fall in the potential at node A, acting through transistors MP7 and MN7, also reduces the potential at node E and thus the gate-source voltage of transistor MN5, making transistor MN5 conduct less drain-source current. Since transistor MP3 has become more conductive and transistor MN5 has become less conductive, the potential at node F rises, charging the gate and reducing the source-drain current flow of transistor MP5. As a result of the changes in the conductivity of transistors MP4 and MP5, the potential Vout1 at the output terminal Vout shifts upward toward Vdd.

The increase in the potential at the output terminal Vout increases the gate-source voltage and drain-source current flow of transistor MN2. The potential at node B therefore falls, increasing the flow of source-drain current through transistor MP2. This increased source-drain current flow is mirrored by transistor MP1, raising the potential of node A and reducing the source-drain current flow through transistor MP3. The fall in the potential at node B, acting through transistors MP6 and MN6, also lowers the potential at node D, reducing the gate-source voltage and drain-source current flow of transistor MN3. The reduced current conductivity of transistor MN3 is mirrored by transistor MN4. The rise in the potential of node A and the reduced conductivity of transistor MN4 combine to raise the potential of node E, increasing the gate-source voltage and drain-source current flow of transistor MN5. The potential at node F is thereby reduced.

The above process continues until the potentials at nodes A, B, D, E, and F converge to values such that the potential Vout1 at the output terminal Vout is again equal to the potential at the input terminal Vin.

Similarly, if the potential at the non-inverting input terminal Vin shifts downward toward Vdm, decreasing the gate-source voltage of transistor MN1, transistor MN1 conducts less drain-source current and the potential at node A rises, charging the gates and decreasing the source-drain current flow of transistors MP3 and MP4. The rise in the potential at node A, acting through transistors MP7 and MN7, also raises the potential at node E, making transistor MN5 conduct more drain-source current. Since transistor MP3 has become less conductive and transistor MN5 has become more conductive, the potential at node F falls, discharging the gate and increasing the source-drain current flow of transistor MP5. As the gate of transistor MP4 charges and the gate of transistor MP5 discharges, the potential Vout1 at the output terminal Vout shifts downward toward Vdm.

The decrease in the potential at the output terminal Vout decreases the gate-source voltage and drain-source current flow of transistor MN2. The potential at node B therefore rises, decreasing the flow of source-drain current through transistor MP2. This decreased source-drain current flow is mirrored by transistor MP1, lowering the potential of node A and increasing the conductivity of transistor MP3. The rise in the potential at node B, acting through transistors MP6 and MN6, also raises the potential at node D, increasing the gate-source voltage and drain-source current flow of transistor MN3. The increased current conductivity of transistor MN3 is mirrored by transistor MN4. The fall in the potential of node A and the increased conductivity of transistor MN4 combine to lower the potential of node E, reducing the gate-source voltage and drain-source current flow of transistor MN5. The potential at node F is thereby increased.

The above process also continues until the potentials at nodes A, B, D, E, and F converge to values such that the potential Vout1 at the output terminal Vout is equal to the potential at the input terminal Vin.

In particular, when the potential of the input terminal approaches Vdm, the push-pull control stage 2*a* can drive node F to a potential below Vdm, allowing the output voltage Vout1 to reach a potential that also approaches Vdm.

Figure 6:
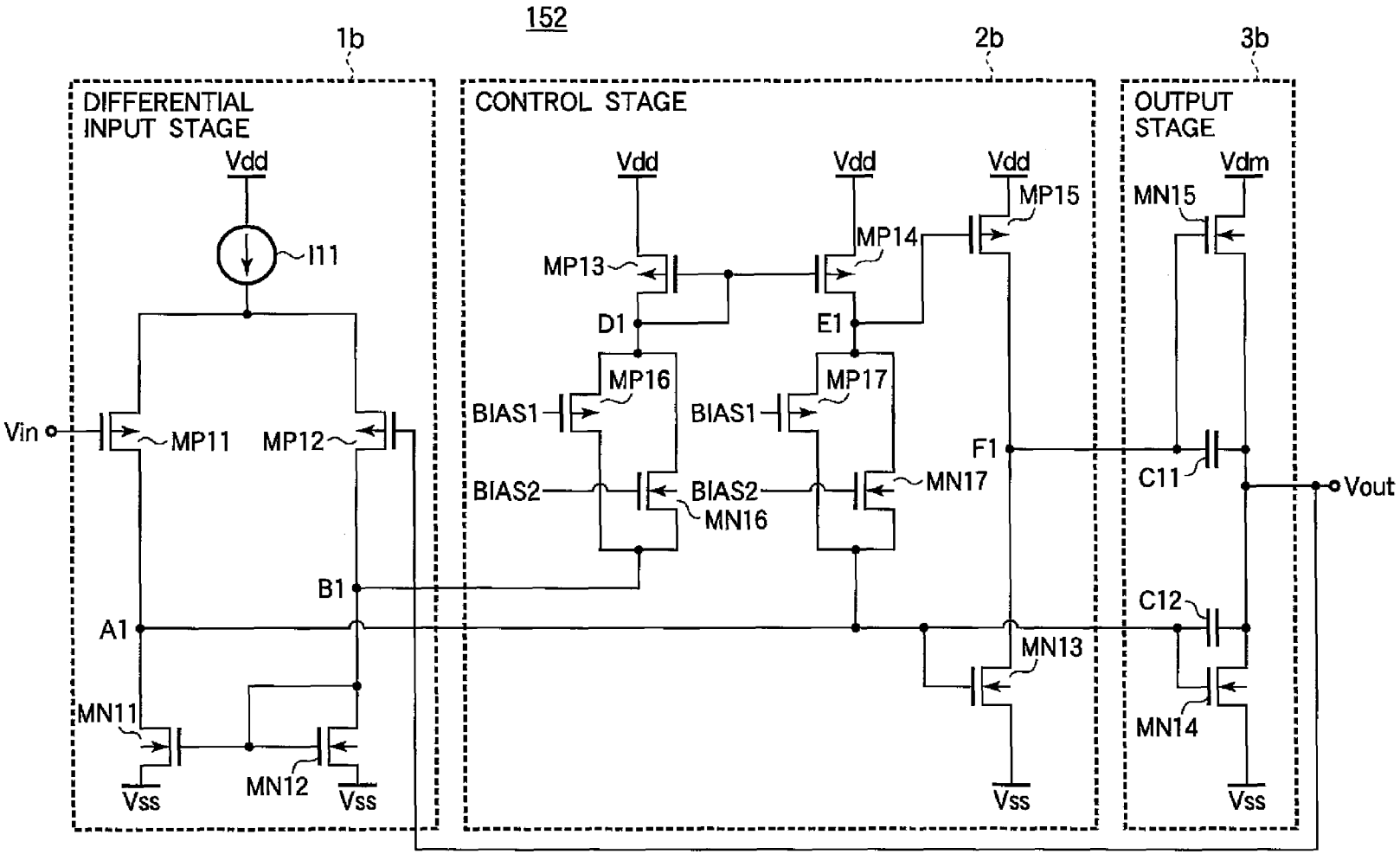
FIG. 6 is a circuit diagram of the sink amplifier in FIGS. 3 and 4.

The sink amplifier 152 is a low-side voltage follower with the circuit configuration shown in FIG. 6, including a differential input stage 1*b*, a control stage 2*b*, and an output stage 3*b*. The differential input stage 1*b* includes a pair of p-channel field-effect transistors MP11, MP12 (the first and second transistors), a pair of n-channel field-effect transistors MN11, MN12, and a current source I11, connected to operate as a differential amplifier.

The gate of transistor MP11 functions as the non-inverting input terminal Vin of the sink amplifier 152. The gate of transistor MP12 functions as the inverting input terminal of the sink amplifier 152 and receives the output voltage Vout2 of the sink amplifier 152 from the output stage 3*b* as feedback. The source terminals of transistors MP11, MP12 are both connected through the current source I11 to Vdd. The source terminals of transistors MN11, MN12 are both connected to Vss. The drains of transistors MP11 and MN11 are interconnected at a node A1 at which the first potential of the sink amplifier 152 is generated. The drains of transistors MP11 and MN11 are interconnected at a node B1 at which the second potential is generated. The gates of transistors MN11 and MN12 are both connected to the drain of transistor MN12, so that transistors MN11 and MN12 operate as a current mirror (the first current mirror).

The control stage 2*b* includes n-channel field-effect transistors MN13, MN16, MN17 and p-channel field-effect transistors MP13 to MP17. The source of transistor MN16 and the drain of transistor MP16 are both connected to node B1 in the differential input stage 1*b*. The drain of transistor MN16 and the source of transistor MP16 are both connected through the source and drain of transistor MP13 to Vdd. The source of transistor MN17 and the drain of transistor MP17 are both connected to node A1 in the differential input stage 1*b*. The drain of transistor MN17 and the source of transistor MP17 are both connected through the source and drain of transistor MN4 to Vdd. The gates of transistors MP13 and MP14 are both connected to the drain of transistor MP13 at a node D1. Transistors MP13 and MP14 form the second current mirror. A first bias voltage BIAS1 is applied to the gates of transistors MP16 and MP17. A second bias voltage BIAS2 is applied to the gates of transistors MN16 and MN17.

Transistor MN13 (the third transistor) and transistor MP15 (the fourth transistor) are connected in a push-pull configuration. Transistor MN13 has its source connected to Vss, its gate connected to node A1 in the differential input stage 1*b*, and its drain connected to the drain of transistor MP15 at a node F1. The potential of node F1 is the control potential output from the control stage 2*b*. Transistor MP15 has its gate connected to the drain of transistor MP14 at a node E1, and its source connected to Vdd. The potential of node E1 is the third potential. Because of the above interconnections of transistors MN16, MN17, MP13, MP14, MP16, and MP17, the potential of node E1 varies in response to the potential difference between nodes A1 and B1. The potential of node E1 is comparatively high when the potential of node A1 is greater than the potential of node B1, and comparatively low when the potential of node A1 is less than the potential of node B1.

The output stage 3*b* includes n-channel field-effect transistors MN14 and MN15 (the fifth and sixth transistors) and a pair of phase compensation capacitors C11, C12. Transistor MN14 has its source connected to Vss and its gate connected to node A1. Transistor MN15 has its drain connected to the reference potential Vdm and its gate connected to node F1. The drain of transistor MN14 and the source of transistor MN15 are mutually interconnected and are both connected to the output terminal Vout of the sink amplifier 152. Capacitor C11 is connected between the gate and source of transistor MN15. Capacitor C12 is connected between the gate and drain of transistor MN14.

The non-inverting input terminal Vin of the sink amplifier 152 receives an input potential in the range from the ground potential Vss to the reference potential Vdm. Starting from a state in which the output potential Vout2 is equal to the input potential, if the potential at the non-inverting input terminal Vin shifts downward toward Vss, increasing the gate-source voltage of transistor MP11, transistor MP11 conducts more source-drain current and the potential at node A1 rises, charging the gates and increasing the drain-source current flow of transistors MN13 and MN14. The rise in the potential at node A1, acting through transistors MN17 and MP17, also raises the potential at node E1 and reduces the gate-source voltage of transistor MP15, making transistor MP15 conduct less source-drain current. Since transistor MN13 has become more conductive and transistor MP15 has become less conductive, the potential at node F1 falls, discharging the gate and decreasing the drain-source current flow of transistor MN15. As a result of the changes in the conductivity of transistors MN14 and MN15, the potential Vout2 at the output terminal Vout shifts downward toward Vss.

The decrease in the potential at the output terminal Vout increases the gate-source voltage and source-drain current flow of transistor MP12. The potential at node B1 therefore rises, increasing the flow of drain-source current through transistor MN12. This increased drain-source current flow is mirrored by transistor MN11, lowering the potential of node A1 and reducing the drain-source current flow through transistor MN13. The rise in the potential at node B1, acting through transistors MN16 and MP16, also raises the potential at node D1, reducing the gate-source voltage and source-drain current flow of transistor MP13. The reduced current conductivity of transistor MP13 is mirrored by transistor MP14. The drop in the potential of node A1 and the reduced conductivity of transistor MP14 combine to lower the potential of node E1, increasing the gate-source voltage and source-drain current flow of transistor MP15. The potential at node F1 is thereby raised.

The above process continues until the potentials at nodes A1, B1, D1, E1, and F1 converge to values such that the potential Vout2 at the output terminal Vout is again equal to the potential at the input terminal Vin.

Similarly, if the potential at the non-inverting input terminal Vin shifts upward toward Vdm, decreasing the gate-source voltage of transistor MP11, transistor MP11 conducts less source-drain current and the potential at node A1 falls, discharging the gates and decreasing the drain-source current flow of transistors MN13 and MN14. The drop in the potential at node A1, acting through transistors MN17 and MP17, also lowers the potential at node E1, making transistor MP15 conduct more source-drain current. Since transistor MN13 has become less conductive and transistor MP15 has become more conductive, the potential at node F1 rises, charging the gate and increasing the drain-source current flow of transistor MN15. As the gate of transistor MN15 charges and the gate of transistor MN14 discharges, the potential Vout2 at the output terminal Vout shifts upward toward Vdm.

The rise in the potential at the output terminal Vout decreases the gate-source voltage and source-drain current flow of transistor MP12. The potential at node B1 therefore falls, decreasing the flow of drain-source current through transistor MN12. This decreased drain-source current flow is mirrored by transistor MN11, raising the potential of node A1 and increasing the conductivity of transistor MN13. The drop in the potential at node B1, acting through transistors MN16 and MP16, also lowers the potential at node D1, increasing the gate-source voltage and source-drain current flow of transistor MP13. The increased current conductivity of transistor MP13 is mirrored by transistor MP14. The rise in the potential of node A1 and the increased conductivity of transistor MP14 combine to raise the potential of node E1, reducing the gate-source voltage and source-drain current flow of transistor MP15. The potential at node F1 is thereby reduced.

The above process continues until the potentials at nodes A1, B1, D1, E1, and F1 converge to values such that the potential Vout2 at the output terminal Vout is equal to the potential at the input terminal Vin.

In particular, when the potential of the input terminal approaches to Vdm, the push-pull control stage 3*a* can drive node F1 to a potential above Vdm, allowing the output voltage Vout1 to reach a potential that also approaches Vdm.

The push-pull configuration of p-channel and n-channel field-effect transistors in the control stages 2*a*, 2*b* of the source amplifier 151 and sink amplifier 152 provides comparatively high gain and current driving capability. These push-pull transistors also respond quickly to changes in the potentials output by the differential input stage, because neither transistor is ever switched completely off. The gate of the field-effect transistor MN15 or MP5 connected to Vdm in the output stage 3*a* or 3*b* is therefore charged or discharged quickly, enabling the driving voltage output at the output terminal Vout to be brought quickly to the level at the input terminal Vin, even when this level shifts toward the reference potential Vdm.

The invention is not limited to the circuit configurations shown in the drawings. For example, other current pass circuits or resistance elements may be used in place of the parallel p-channel and n-channel transistors MP6 and MN6, MP7 and MN7, MP16 and MN16, and MP17 and MN17 in the control stages 2*a* and 2*b*.

Those skilled in the art will recognize that further variations are possible within the scope of the invention, which is defined in the appended claims.

What is claimed is:

1. A driving voltage output circuit having a plurality of high-side voltage followers and a plurality of low-side voltage followers, the high-side voltage followers outputting driving voltages equal to or greater than a reference potential and equal to or less than a high-side power supply potential, the low-side voltage followers outputting driving voltages equal to or greater than a low-side power supply potential and equal to or less than the reference potential, the driving voltages being supplied to column lines in a matrix display panel responsive to display data, each column line being periodically switched between receiving a driving voltage from one of the high-side voltage followers and receiving a driving voltage from one of the low-side voltage followers, each of the high-side voltage followers and each of the low-side voltage followers separately comprising:

a differential input stage having an inverting input terminal, a non-inverting input terminal, a first transistor with a control terminal connected to the non-inverting input terminal, a second transistor with a control terminal connected to the inverting input terminal, and a first current mirror connected to controlled terminals of the first and second transistors to supply the second transistor with a current equal to a current conducted by the first transistor, the first and second transistors operating as a differential amplifier to generate a first potential at a node at which the first transistor and the first current mirror are interconnected and a second potential at a node at which the second transistor and the first current mirror are interconnected;

a control stage including a control circuit for generating a third potential responsive to a difference between the first potential and the second potential, a third transistor with a control terminal receiving the first potential, and a fourth transistor with a control terminal receiving the third potential, the third and fourth transistors being of mutually opposite channel types, the third and fourth transistors being connected in a push-pull configuration between a terminal supplying the high-side power supply potential and a terminal supplying the low-side power supply potential to generate a control potential at a node at which the third and fourth transistors are mutually interconnected; and an output stage including a fifth transistor with a control terminal receiving the first potential and a sixth transistor with a control terminal receiving the control potential, the fifth and sixth transistors being of mutually identical channel types, the fifth and sixth transistors being connected in series between a terminal supplying a particular power supply potential and a terminal supplying the reference potential to generate a driving voltage at an output terminal at which the fifth and sixth transistors are mutually interconnected, the particular power supply potential being the high-side power supply potential in the high-side voltage followers and the low-side power supply potential in the low-side voltage followers, the output terminal being connected to the inverting input terminal of the input stage and to one of the column lines.

2. The driving voltage output circuit of claim 1, wherein:

the control terminals of the third and fifth transistors are connected to the node at which the first transistor and the first current mirror are interconnected; and the control terminal of the sixth transistor is connected to the node at which the third and fourth transistors are interconnected.

3. The driving voltage output circuit of claim 1, wherein the control circuit in the control stage further comprises:

a first current pass circuit having a seventh transistor with a control terminal receiving a first bias potential and an eighth transistor with a control terminal receiving a second bias potential, the seventh and eighth transistors being of mutually opposite channel types, the seventh and eighth transistors being connected in parallel to a node receiving the second potential from the input stage;

a second current pass circuit having a ninth transistor with a control terminal receiving the first bias potential and an tenth transistor with a control terminal receiving the second bias potential, the ninth and tenth transistors being of mutually opposite channel types, the ninth and tenth transistors being connected in parallel to a node receiving the first potential from the input stage; and a second current mirror connected to the first and second current pass circuits to supply the second current pass circuit with a current equal to the current conducted by the first current pass circuit, the third potential being generated at a node at which the second current pass circuit and the second current mirror are interconnected.

4. The driving voltage output circuit of claim 3, wherein:

the seventh and eighth transistors are both connected to the node at which the second transistor and the first current mirror are interconnected; and the ninth and tenth transistors are both connected to the node at which the first transistor and the first current mirror are interconnected.

5. The driving voltage output circuit of claim 1, wherein:

in the high-side voltage followers the first, second, and fourth transistors are n-channel field effect transistors and the third, fifth, and sixth transistors are p-channel field effect transistors; and in the low-side voltage followers the first, second, and fourth transistors are p-channel field effect transistors and the third, fifth, and sixth transistors are n-channel field effect transistors.

* * * * *